United States Patent [19]

Finnigan

[11] Patent Number: 4,984,637

[45] Date of Patent: Jan. 15, 1991

[54] ELECTRONIC FIRE PROTECTION SYSTEM

[76] Inventor: Wilfred J. Finnigan, RR7-S4-C27, Vernon, British Columbia, Canada, V1T 7Z3

[21] Appl. No.: 370,825

[22] Filed: Jun. 23, 1989

[51] Int. Cl.[5] ..... A62C 39/00

[52] U.S. Cl. ..... 169/61; 169/9; 169/19

[58] Field of Search ..... 169/9, 13, 14, 15, 19, 169/27, 37, 43, 44, 46, 47, 54, 60, 61, 90; 236/49.2, 49.3; 337/304, 323, 360; 340/289, 529, 584

[56] References Cited

U.S. PATENT DOCUMENTS

| | | | |
|---|---|---|---|
| 3,156,908 | 11/1964 | Kopan et al. . | |
| 4,101,887 | 7/1978 | Osborne . | |
| 4,305,469 | 12/1981 | Morrisette . | |
| 4,388,616 | 6/1983 | Machida . | |
| 4,432,272 | 2/1984 | Becelaere | 236/49.2 |
| 4,434,855 | 3/1984 | Given | 169/90 |
| 4,553,602 | 11/1985 | Pieczykolan | 169/90 |
| 4,638,866 | 1/1987 | Capasso et al. | 169/90 |
| 4,706,758 | 11/1987 | Johnson | 169/90 |
| 4,741,403 | 5/1988 | Nihimura | 169/61 |

*Primary Examiner*—Sherman Basinger
*Assistant Examiner*—Stephen P. Avila
*Attorney, Agent, or Firm*—William A. Blake; John J. Leavitt

[57] ABSTRACT

An electronic fire protection system is disclosed which includes a central control circuit that operates a sprinkler, or other extinguishing system in responsive to a sensed overtemperature condition. The trigger temperature of the system is adjustable, and the control circuit automatically resets after the sensed temperature has been reduced substantially below the trigger temperature. An audible alarm is also actuated by the control circuit that must be manually reset to ensure that the occurrence of a fire when the protected area is vacant will not go unnoticed. A visual temperature display is provided that can be operated in a power saving mode when external power for the circuit is lost, and a battery backup is actuated. A combination valve/nozzle is utilized in the controlled extinguishing system which is normally spring biased closed, and opened in response to extinguishate pressure. The valve/nozzle includes a valve head having a specially shaped sealing surface and deflector lip that generates a patterned spray when the valve is opened.

15 Claims, 3 Drawing Sheets

FIG. 4A
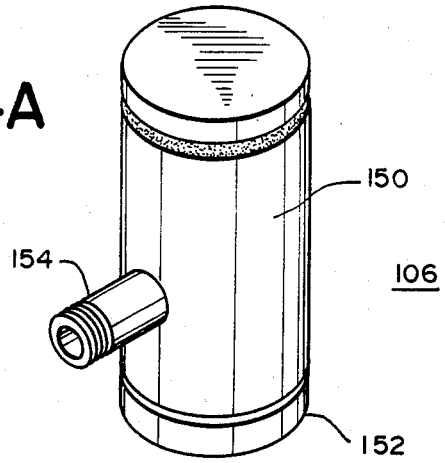
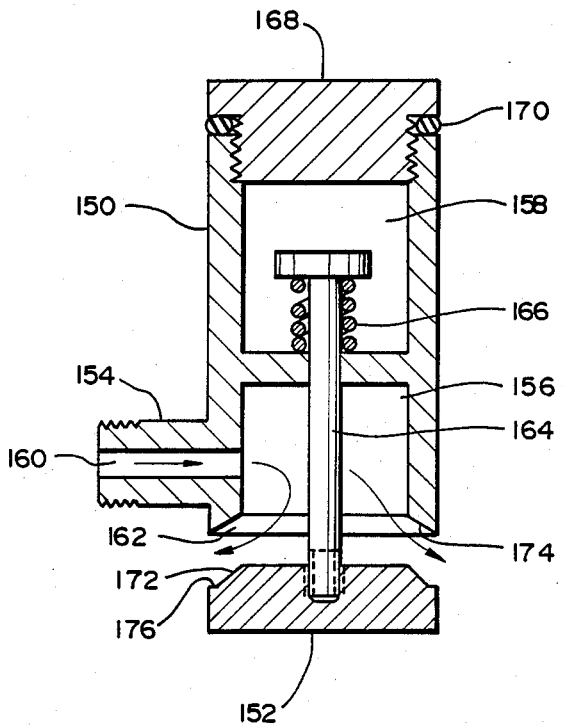
FIG. 4B

ELECTRONIC FIRE PROTECTION SYSTEM

BACKGROUND OF THE INVENTION

This present invention relates to a fire protection system, and particularlY to a method and apparatus for electronic fire detection and/or fire extinguishment for use with chimneys, range hoods, commercial buildings, domestic dwellings, or other premises.

Conventional fire protection systems for commercial buildings and warehouses, and domestic dwellings, typically employ water sprinkler systems, or the like, in which one or more spray nozzles are employed to direct water or other fire extinguishate onto a fire. These sprinkler systems are usually pressurized either with air or water, and are actuated in response to the melting of fusible seals at the spray nozzles by a fire. Once activated, the sprinklers continue to operate until the source of water or other extinguishate is exhausted, or otherwise manually shut off.

These types of systems are undesirable for a number of reasons. First, since the amount of Water or extinguishate dispensed by the systems is not automatically controlled, it is quite possible that much of the extinguishate will be wasted, and may cause unnecessary damage to the protected area. In systems having a limited supply of extinguishate, this also adds the expense of having to fully recharge the system before it can be used again. Further, once one or more fusible seals have been melted by the heat of a fire, the sprinkler system obviously cannot be used again until those fusible seals are replaced. Again, this adds additional cost and inconvenience to the use of such a system.

In situations where a sprinkler system is actuated in an unattended building, such as a warehouse, it is possible that a fire could actuate the sprinkler system, be extinguished thereby, and go unnoticed for some period of time. It is possible, for example that the source of extinguishate could be unknowingly exhausted Further, even if it is known that the sprinkler system has been activated, it may be quite difficult to determine Which of a plurality of fusible seals located throughout a large building have been melted.

SUMMARY OF THE INVENTION

It is therefore an object of the present invention to provide a fire detecting and extinguishing system which is automatically actuated in response to the heat of a fire, and which is automatically reset after the fire has been extinguished.

It is a further object of the present invention to provide a fire detecting and extinguishing system in which visual and/or audible alarms or indicators are employed to provide an indication as to the condition of the system and the protected premises.

A still further object the invention is to provide a temperature responsive electronic fire protection system whose actuation temperature is adjustable.

Another object of the invention is to provide an electronic fire protection system which includes a backup power supply, system malfunction indicator means, and power saving features.

It is yet another object of the invention to provide a fire protection sYstem which employs a unique valve construction for supplying water or other extinguishate to a protected area that is self sealing when the system is not in operation, is constructed to withstand adverse operating conditions, and eliminates the need for a separate nozzle or spray pattern forming structure.

These and other objects of the present invention are achieved through provision of an electronic fire protection system which includes one or more temperature sensors disposed in an area to be protected, such as a chimney, range hood, commercial building, or other premises. The temperature sensors are connected to a central control circuit which in response to the signals generated by the sensors, controls the operation of a sprinkler or other extinguishing system, as well as an alarm or other condition indication system. The central control circuit includes means to adjust the temperature at which the sprinkler will be actuated, and a visual indication is provided to indicate the temperature of the area being monitored.

The central control circuit is powered by low voltage DC that is normally obtained through a conventional plug in adaptor from 120 VAC. In the event of a power outage, a nine volt battery provides backup power to the control circuit. In addition, when the main power fails, the control circuit automatically responds to save the power to the battery by turning off a number of the visual displays.

When an overtemperature condition is sensed by the temperature sensor that is indicative of a fire, the control circuit actuates a solenoid valve that supplies water or other extinguishate to a combination valve/nozzle disposed in the protected area. At the same time, an audible or visual alarm is actuated to indicate that a fire has been sensed and that the fire extinguishing system has been actuated. The system is caused to actuate until the sensed temperature is reduced to a set level, although the alarm continues to be activated until manuallY reset. This feature ensures that if a fire occurs while the protected premises is unoccupied, it Will not go unnoticed. Once the sensed temperature is reduced to a preset level, the extinguishing system is deactivated, and the fire protection system is reset. The central control circuit can also be employed to activate relays or other switches in response to an overtemperature condition to turn off appliances, ventilation systems, gas valves, etc.

When the central control circuit actuates the solenoid valve for the extinguishing system, water or other extinguishate is supplied under pressure to one or more valve structures disposed in the area to be protected Each of these valves is normally held in a closed position by a bias spring. The pressure of the water or extinguishate overcomes the force of the spring and pushes the valve to an open position. The valve face and seat are configured so that a spray pattern is formed as the water or extinguishate is expelled from the valve. This eliminates the need for a separate nozzle or spray forming structure. Once the central control system resets the system, and closes the solenoid valve, the spray valve automatically closes under the pressure of the spring. The shape of the valve sealing surface further helps ensure that contaminants from the fire, such as soot and grease, will not interfere with the proper opening and closing of the valve. When the system is reset by the central control circuit, an additional solenoid valve can be optionally employed to drain excess water from the extinguishing system.

BRIEF DESCRIPTION OF THE DRAWINGS

The foregoing and additional objects, features, and advantages of the present invention will become apparent from a consideration of the following detailed description of the preferred embodiment thereof, taken in conjunction with the accompanying drawings, in which:

FIG. 4A is a perspective illustration of a combination valve and nozzle assembly for use with the sprinkler system of FIG. 3; while FIG. 4B is a cross sectional view of the same.

DETAILED DESCRIPTION OF A PREFERRED EMBODIMENT

Figure 1:
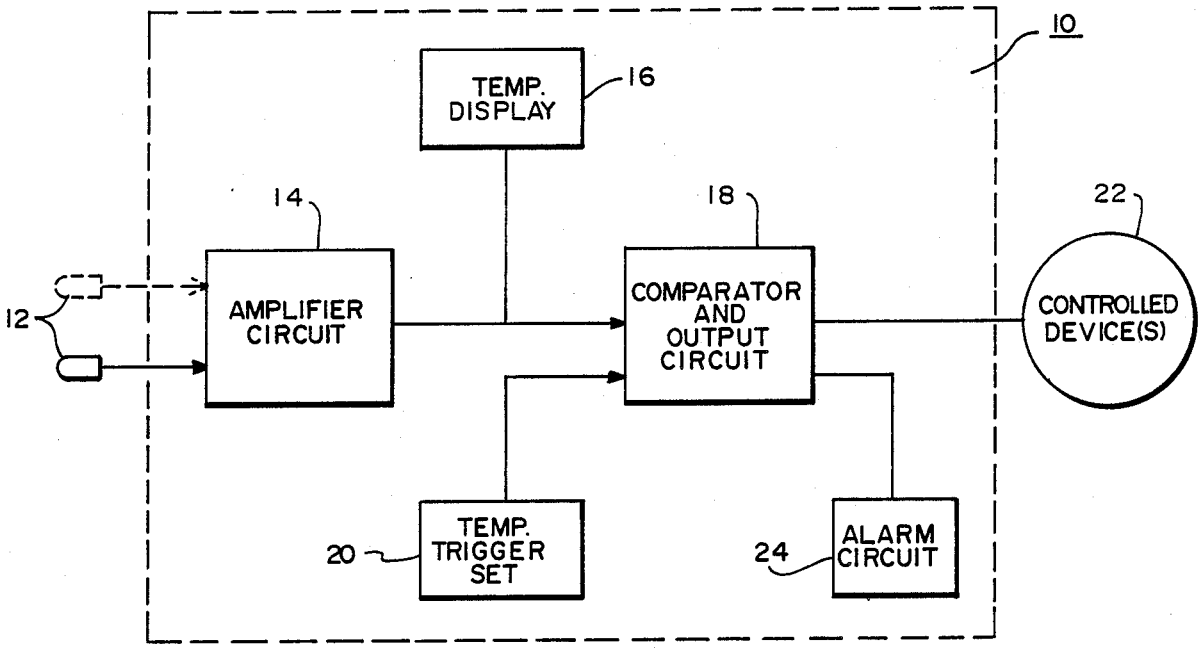
FIG. 1 is a schematic block diagram illustrating the general arrangement of a central control circuit for the present invention.

Turning now to a more detailed consideration of the present invention, there is illustrated in FIG. 1, a central control circuit 10 for a fire protection system which receives an input signal from one or more electronic temperature sensors 12. Temperature sensors 12 are disposed in the area to be protected, such as a chimney, range hood, etc., and are preferably K type thermocouples, or similar devices, which generate a voltage that varies proportionally to the ambient temperature.

The input(s) from sensor(s) 12 is (are) fed to an interface or amplifier circuit 14 which conditions and calibrates the input signals so they are suitable for use by the control circuit 10. From amplifier circuit 14, the temperatures signals are sent to a temperatures display circuit !6, and a comparator and output circuit 18. Another input to comparator and output circuit 18 is obtained from a temperature trigger circuit 20, which can be pre-set to any desired trigger point so that comparator circuit 18 will generate an output voltage any time the temperature of one or more of the sensors 12 exceeds the trigger point. In the case of a chimney, the trigger point is set around 1000° F, whereas in the case of a restaurant range hood, the trigger point is set around 325° F. Once the trigger point is exceeded, comparator circuit 18 is constructed so that it will continue to generate an output voltage until the temperature of the sensors 12 is reduced to a lower value, for example 50 percent of the trigger temperature.

The output from comparator circuit 18 is fed to one or more output devices 22 such as a solenoid valve for a sprinkler system, and relays or other electrical switches for appliances, gas shut off valves, etc. The output from comparator circuit 18 is also fed to an alarm circuit 24 which, once actuated, will continue to sound until it is manually reset. This insures that if the fire protection system is actuated and subsequently reset when the protected premises is vacant, the fact that it has been actuated will not go unnoticed.

Figure 2:
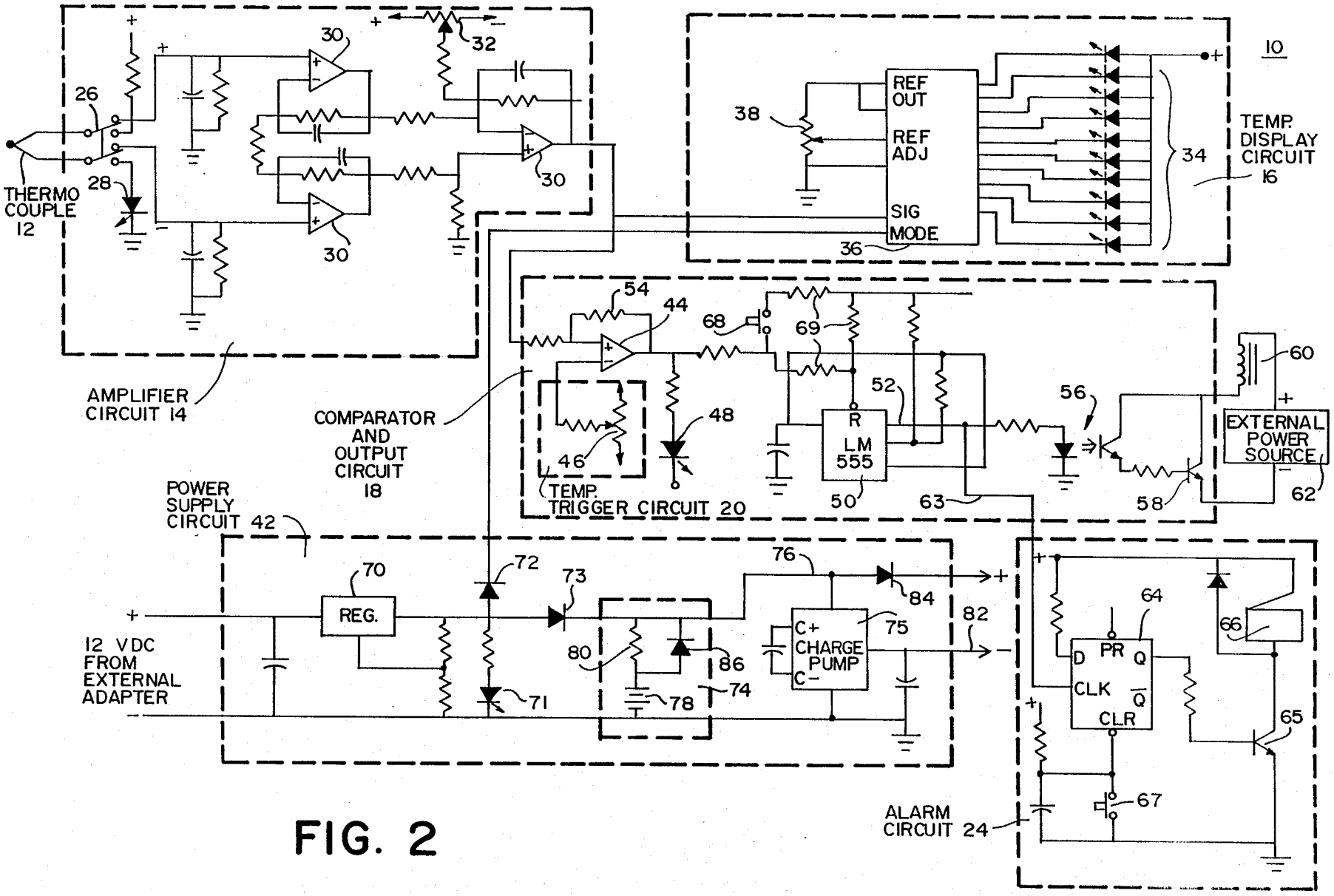
FIG. 2 is a detailed schematic circuit diagram of the central control circuit of the present invention.

Turning now to FIG. 2, a detailed circuit diagram of one embodiment of central control circuit 10 is illustrated. Amplifier circuit 14 includes a switch 26 which selectively connects thermocouple 12 to either a test indicator LED 28 and a source of dc Voltage for testing the thermocouple connections, or to a plurality of operational amplifiers 30. These are configured as a conventional differential amplifier that provides differential dc amplification to the output from thermocouple !2. A variable resistance or potentiometer 32 is connected to the input of the final stage of the amplifier so that the output bias can be shifted slightly to calibrate the thermocouple output when the chimney or protected area is cold. Typically the output of amplifier circuit 14 will be a 4 volt signal for a 40 mv thermocouple differential input signal resulting from a sensed temperature of about 1000 degrees F.

The output from amplifier circuit 14 is directed to temperature display circuit 16 and comparator and output circuit 18. Temperature display circuit 16 includes a plurality of LEDs 34 which are individually driven from separate outputs of a driver circuit 36. Driver circuit 36 normally supplies voltage to LEDs 84 to simulate a bar graph with additional LEDs being lit as the sensed temperature increases The full scale temperature range is adjusted via a potentiometer 88.

Temperature display 16 has two modes of operation. When central control circuit 10 is powered by AC power, the display operates like a bar graph as described above. When, however, the AC power is cut off and the circuit is operated by a battery backup, a power sensing feature is triggered which causes driver circuit 36 to actuate only the one LED that corresponds to the sensed temperature. This is accomplished by feeding a signal to a mode input 40 of driver circuit 36 from a power supply circuit 42 when AC power is lost. The details of power supply circuit 42 are discussed below.

Comparator and output circuit 18 includes an operational amplifier 44, Which operates as a comparator and receives a first input from the output signal of amplifier circuit 14, and a second input from temperature trigger circuit 20. Trigger circuit 20 includes a potentiometer 46 which permits adjustment of the temperature at which the central control circuit 10 will generate an output.

As long as the input voltage from amplifier circuit 14 remains less than that from trigger circuit 20, operational amplifier 44 will not generate a positive voltage output. When thermocouple 12 is exposed to fire, however, and amplifier circuit 14 generates a voltage higher than that of trigger circuit 20, operational amplifier 44 generates a positive voltage that is fed to a trigger indicating LED 48, and the RESET input of an LM555 timer circuit 50.

When the RESET input is high, timer circuit 50 is allowed to run as an astable multivibrator producing an asymmetrical square wave on an output line 52. The "on" time of the square wave is approximately 14 seconds while the "off" time is approximately 4 seconds. A resistor 54 placed between the input to operational amplifier 44 from amplifier circuit 14, and the output of operational amplifier 44, adds some hysteresis to the comparator's operation so that once triggered, the sensed temperature must fall to approximately 50 percent of the trigger temperature before timer circuit 50 is reset. This feature adds stability to the design, and ensures that the extinguishing system controlled by the central control circuit 10 operates for a long enough period of time to sufficiently extinguish a fire, or otherwise cool the protected area. The value of resistor 54 can be selected as desired to vary the temperature at which timer circuit 50 resets depending on the application.

The square wave output from timer circuit 50 is fed via output line 52 to an opto-isolator circuit 56, Which controls the switching of a solenoid driver transistor 58. Driver transistor 58 connects a solenoid valve 60, which is disposed in a sprinkler, or other, extinguishing system (to be described in further detail below), to an external power supply 62. Power supply 62 can be any suitable source of power, such as a battery, or a DC supply with a battery backup As long as timer circuit 50 is allowed run, solenoid valve 60 will be operated by supply 62 in a pulse width modulated manner and the sprinkler or extinguishing system will supply water or other extinguishate to the protected area. Once the sensed temperature is reduced to about 50 percent of the trigger temperature, timer circuit 50 will be reset, driver transistor 58 will switch off, and the solenoid valve 60 Will remain closed, thereby turning the sprinkler system off.

Output line 82 from the timer circuit 50 is also connected via a line 63 to a delay type flip flop 64 in alarm circuit 24. When the timer circuit generates a square wave output, flip flop 64 will be set, and the Q output will go high. The Q output is connected to the base of a switching transistor 65 that is disposed between an alarm buzzer 66 and ground. When the Q output goes high, transistor 65 will saturate and activate buzzer 66 by completing its power circuit to ground. Buzzer 66 will continue to sound even when pulses are no longer supplied to flip flop 64, since the flip flop is latched in the set position. In order to deactivate buzzer 66, flip flop 64 is manually reset with a reset switch 67 disposed between the CLR input of flip flop 64 and ground.

To test the integrity of the solenoid valve 60 and the alarm circuit 24, a manually operated test water spray switch 68 is disposed in one leg of a resistance bridge 69 between operational amplifier 44 and the RESET input of timer circuit 50. When switch 68 is closed, the resultant resistance change will cause the RESET input of the timer circuit 50 to go high and manually trigger solenoid valve 60 and alarm circuit 24. When switch 68 is released to its open position the timer circuit 50 will automatically reset, however, reset switch 67 will have to be closed in order to reset alarm circuit 24.

The power supply circuit 42 for control circuit 10 is normally supplied with 12 volts DC from an external 120 VAC/12 VDC plug-in adaptor (not shown). A regulator circuit 70 reduces the 12 volt input down to about 9.6 volts and supplies this voltage to an "AC power on" indicator LED 71; through a diode 72 to the mode input 40 of LED driver circuit 36 and through another diode 73 to a battery backup circuit 74, a charge pump circuit 75, and a positive voltage output 76 which is connected to all of the various amplifiers and circuit elements of control circuit 10 (as indicated by the "+" signs in FIG. 2).

During normal operation, the 9.6 volt signal will charge a 9 volt nickel cadmium battery 78 through a resistor 80, and will allow charge pump circuit 75 to generate a negative DC voltage on a negative voltage output 82 that is necessary to run the various operational amplifiers of the control circuit 10. A diode 84 is disposed in the positive voltage output 76 to drop the positive voltage slightly to make the positive and negative outputs approximatelY equal.

When the AC power fails, and the 12 volt DC input to power supplY 42 is reduced to zero, diode 72 no longer conducts current to the mode input of LED driver circuit 36, and the driver circuit will switch to the power saving mode discussed previously where only a single one of the plurality of LEDs 34 will be illuminated. At the same time, battery 78 will automatically supply voltage through another diode 86 to charge pump circuit 75 and positive output 76, While "AC power on" indicator LED 71 will be turned off.

Figure 3:
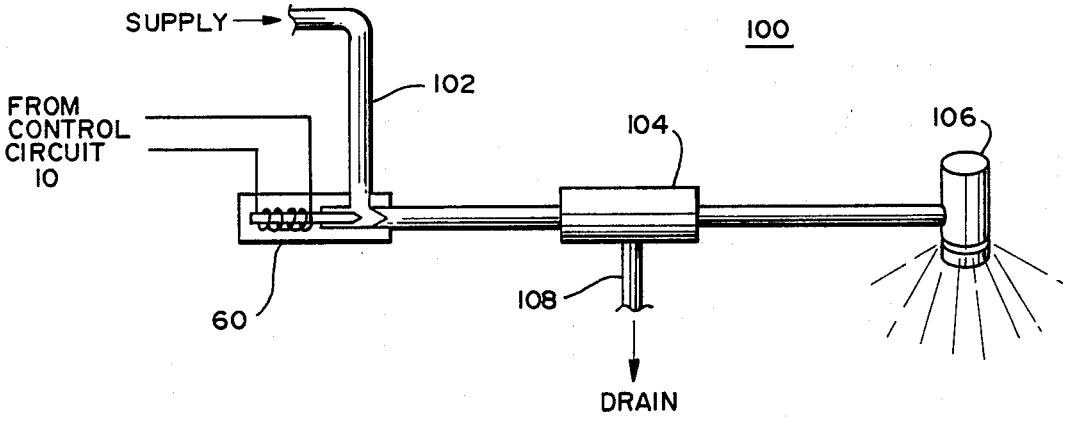
FIG. 3 is a schematic diagram of a sprinkler system employed with the present invention.

Turning now to FIG. 3, there is illustrated a sprinkler system 100 which can be employed with the fire protection system, and operated by central control circuit 10 of FIGS. 2 and 3. Sprinkler sYstem 100 includes a water or other extinguishate supply pipe 102 which is connected through solenoid valve 60 of FIG. 3, and a three way valve 104, to a combination valve/spray nozzle 106 that is disposed in the area to be protected, and is normally spring biased closed. Three way valve 104 normally connects supply pipe 102 to valve/nozzle 106, but can be actuated by any suitable means (not shown) to connect valve/nozzle 106 to a drain pipe 108 to purge the system of excess water after the operation thereof. When solenoid valve 60 is actuated by control circuit 10, high pressure water or other extinguishate is supplied to valve/nozzle 106, which opens in response to the pressure, and emits a patterned spray into the protected area to extinguish a fire, or otherwise cool the area.

Valve/nozzle 106 is illustrated in greater detail in FIG. 4A, and includes a cylindrical nozzle body 150, and a cylindrical valve head 152 disposed at the bottom end thereof. An input fitting 154 is formed on one side of nozzle body 150 for connection to supply pipe 102 of FIG. 3.

The details of valve/nozzle 106 are illustrated in the cross sectional view of FIG. 4B. As shown, nozzle body, 150 has a hollow interior that is divided into an upper and a lower section 156 and 158, respectively Upper section 156 communicates an inlet passage 160 in fitting 164 to a valve opening 162. Lower sectlon 158 houses a valve stem member 164 and a spring 166 Which surrounds stem 164. A cap nut 168 and an associated rubber washer or seal 170 are threaded into the bottom end of nozzle body 150 to seal the same.

Valve 152 is threaded onto the top end of valve stem 164, and includes a conical sealing surface 172 which mates with a matched conical sealing surface 174 in valve opening 162 of nozzle body 150. An angled deflector lip 176 is formed near the outer edge of valve 152 which serves to deflect dispensed water or extinguishate to form a desired spray pattern. The shape of conical sealing surface 172 allows the maximum lifting pressure to be transmitted to valve 152 by the extinguishate in order to break any seal caused by grease, soot, creosote, etc.

In the operation of valve/nozzle 106, water or extinguishate pressure in upper section 156 forces valve 152 to open against the force of spring 166, and conical sealing surface 172 and deflector lip 176 cause a circular spray pattern of water to be formed which is particularly suited for extinguishing a fire in the protected area. After a fire has been contained, and the sensed temperature reduced enough to shut-off the sprinkler system, valve 152 will automatically shut under the force of spring 166, with conical sealing surfaces 172 and 174 ensuring a tight seal that is resistant to contaminates from a fire, or the environment.

Although the invention has been disclosed in terms of a preferred embodiment, it will be understood that numerous modifications and variations could be made thereto, without departing from the sPirit and scope of the invention as set forth in the following claims.

What is claimed is:

1. A fire protection system comprising:

electronic temperature responsive sensing means disposed in an area to be protected;

control circuit means having an input connected to said sensing means and an output, and including means to generate an output signal when the temperature in an area to be protected exceeds a first set point;

means connected to said output and responsive to said output signal to operate a fire extinguishing system when the temperature in an area to be protected exceeds the first set point; and, means in said control circuit to discontinue said output signal when the sensed temperature is reduced below a second set point substantially below said first set point, and thereby disable the fire extinguishing system.

2. The fire protection system of claim 1, further comprising:

alarm means responsive to said output signal which will continue to be actuated even when said output signal is discountinued; and, means to manually reset said alarm means.

3. The fire protection system of claim 1, further including a temperature display means connected to said temperature responsive sensing means.

4. The fire protection system of claim 1, further including means to adjust said first set point at which an output signal is generated.

5. The fire protection system of claim 1, further comprising a fire extinguishing system including:

a pressurized source of fire extinguishate connected through a line to a dispensing valve disposed in an area to be protected;

supply valve means disposed in said line to control the flow of extinguishate to said dispensing valve; and supply valve operating means controlled by said output signal to open said supply valve when the sensed temperature in a protected area exceeds said first set point, and deliver extinguishate to said dispensing valve.

6. The fire protection system of claim 5, wherein said dispensing valve includes a valve member that is spring biased closed, and opens in response to extinguishate pressure.

7. The fire protection system of claim 6, wherein said dispensing valve further includes a valve head having deflector means formed thereon to create a patterned spray of extinguishate when said dispensing valve is open, and extinguishate is passed therethrough.

8. The fire protection system of claim 1 wherein said second set point is approximately 50 percent below said first set point.

9. The fire protection system of claim 1, further including power supply circuit means for said control circuit means which is normally powered by an external source of power, and includes a battery backup circuit for automatically supplying power when the external source of power is disconnected.

10. The fire protection system of claim 1 further including means to manually generate an output signal to test the system.

11. A combination valve spray nozzle comprising:

a nozzle body having an inlet and an outlet;

an inlet pressure responsive valve disposed in said outlet;

spring biasing means to urge said valve into a closed position;

a first conical sealing surface disposed on said outlet, and a second mating conical sealing surface disposed on said valve, said conical sealing surfaces being shaped to permit the maximum lifting pressure to be imparted to said valve by inlet pressure to open said valve; and, an angled deflector lip disposed on said valve to form a desired spray pattern.

12. A fire protection system comprising:

electronic temperature responsive sensing means disposed in an area to be protected;

control circuit means having an input connected to said sensing means and an output, and including means to generate an output signal when the temperature in an area to be protected exceeds a set point;

means connected to said output and responsive to said output signal to operate a fire extinguishing system when the temperature in an area to be protected exceeds a set point;

means in said control circuit to discontinue said output signal when the sensed temperature is reduced to a point substantially below said set point, and thereby disable the fire extinguishing system; and, a temperature display means connected to said temperature responsive sensing means, wherein said temperature display means comprising a plurality of LEDs that are sequentially illuminated by a driver circuit in response to the sensed temperature so that the number of DEDs illuminated is directly proportional to the sensed temperature.

13. The fire protection system of claim 12, further including power supply circuit means for said control circuit means which is normally powered by an external source of power, and includes a battery backup circuit for automatically supplying power when the external source of power is disconnected.

14. The fire protection system of claim 13, wherein said driver circuit includes means connected to said power supply circuit to sense when the external source of power is disconnected, and means responsive thereto, to illuminate only a single of said plurality of LEDs in response to said sensed temperature to save power.

15. A fire protection system comprising:

electronic temperature responsive sensing means disposed in an area to be protected;

control circuit means having an input connected to said sensing means and an output, and including means to generate an output signal when the temperature in an area to be protected exceeds a set point;

means connected to said output and responsive to said output signal to operate a fire extinguishing system when the temperature in an area to be protected exceeds a set point;

means in said control circuit to discontinue said output signal when the sensed temperature is reduced to a point substantially below said set point, and thereby disable the fire extinguishing system;

a pressurized source of fire extinguishate connected through a line to a dispensing valve disposed in an area to be protected;

supply valve means disposed in said line to control the flow of extinguishate to said dispensing valve;

supply valve operating means controlled by said output signal to open said supply valve when the sensed temperature in a protected area exceeds said set point, and deliver extinguishate to said dispensing valve; and, a drain valve disposed in said line between said supply valve and said dispensing valve to drain excess extinguishate from said line when said supply valve is closed.

* * * * *